US007059024B2

(12) United States Patent
Yoneoka et al.

(10) Patent No.: US 7,059,024 B2
(45) Date of Patent: Jun. 13, 2006

(54) SLIDE FASTENER

(75) Inventors: Morimasa Yoneoka, Toyama-ken (JP); Keiichi Keyaki, Toyama-ken (JP); Kiyoshi Oda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/771,369

(22) Filed: Feb. 5, 2004

(65) Prior Publication Data

US 2004/0154144 A1 Aug. 12, 2004

(30) Foreign Application Priority Data

Feb. 7, 2003 (JP) ..... 2003-030965

(51) Int. Cl.
*A44B 19/04* (2006.01)
*A44B 19/12* (2006.01)

(52) U.S. Cl. ..... 24/391; 24/393

(58) Field of Classification Search ..... 24/391, 24/393, 415, 427, 428
See application file for complete search history.

(56) References Cited

U.S. PATENT DOCUMENTS

| | | | | |
|---|---|---|---|---|
| 3,849,842 | A * | 11/1974 | Yoshida | 24/393 |
| 3,925,857 | A | 12/1975 | Kihara | |
| 4,064,602 | A * | 12/1977 | Heimberger | 24/393 |
| 4,442,685 | A * | 4/1984 | Matsuda | 66/193 |
| 4,488,337 | A * | 12/1984 | Yoshida et al. | 24/395 |
| 4,498,316 | A * | 2/1985 | Matsuda | 66/196 |
| 4,675,950 | A * | 6/1987 | Tsubokawa | 24/390 |
| 6,148,643 | A * | 11/2000 | Matsuda et al. | 66/193 |
| 6,330,892 | B1 * | 12/2001 | Shimono | 24/393 |
| 6,530,132 | B1 * | 3/2003 | Yamagishi et al. | 24/427 |
| 6,622,351 | B1 * | 9/2003 | Takasawa | 24/415 |
| 2002/0017010 | A1 * | 2/2002 | Neugebauer | 24/391 |

FOREIGN PATENT DOCUMENTS

| | | |
|---|---|---|
| EP | 1 036 517 | 9/2000 |
| EP | 1 048 238 | 11/2000 |
| JP | 2000-262309 | 9/2000 |

OTHER PUBLICATIONS

Search Report for Application EP 04 25 0567 dated May 27, 2004.

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

Fastener elements are attached to a side edge of a fastener tape composed of a knitting structure. An interval between the elements and a wale in the vicinity of the elements is formed into a thin knitted fabric. A flange on a side of a rear mouth of a slider is disposed on the thin knitted fabric and the slider is slid based on this section. For this purpose, an outer side of a bottom end face of the flange is cut out to provide with a notch portion, so that this portion is formed with a small width. Consequently, the thin knitted fabric is slid and introduced securely, and making a pressure contact with a surface of the wale is prevented. Even if a fastener is mounted on trousers and its fabric is pulled in a lateral direction forcibly to open, the elements are prevented from biting into a tape guide groove and escaping.

8 Claims, 3 Drawing Sheets

SLIDE FASTENER

BACKGROUND OF THE INVENTION

1. Field of the Invention

The present invention relates to a slide fastener having a slider which is adapted to a fastener chain, in which a knitting structure is used for a fastener tape and fastener elements are attached to a side edge of the tape of the knitting structure.

2. Description of the Related Art

Conventionally, a slide fastener has a slider which is slidable along fastener elements and by sliding the slider, the fastener elements are engaged or disengaged so as to close or open the slide fastener. Generally, the sliding operation of the slider is executed by pulling a pull attached to the slider with user's fingers.

Some users sometimes try to open the slide fastener attached to a fabric of clothes, bag, or the like by pulling the fabric forcibly without operating the pull of the slider. Particularly, this tendency is remarkable in a slide fastener attached to fabric of trousers. This action may make the fastener elements caught into a tape guide groove between a flange of the slider and an opposing blade thereby possibly disabling the sliding of the slider.

To solve this problem, for example, Japanese Patent Application Laid-Open No. 2000-262309 (Document 1) has disclosed a slide fastener as shown in FIG. 5, in which a slider 1' is mounted on a fastener chain having coil fastener elements provided on a side edge of a tape in the fastener tape and in the slider 1', the lateral width of a rear end located at a rear mouth 11' side of the flange 9' is larger than the lateral width of a front end located at a shoulder mouth 10' side, so that the flange is expanded gradually from the rear end to the front end, and a top surface of the flange 9' has a flat portion 31' parallel to the blade 6', such that a gap between the blade 6' and the flat portion 31' formed on the top surface of the flange 9' is slightly larger than the thickness of the fastener tape.

In the slide fastener disclosed in Document 1, in order to prevent the coil fastener elements from escaping from the slider 1', the flange 9' is provided with a wide end face portion 32' having a large width at the front end of the flange, inverted portions adjoining each other of the coil fastener elements contacting the wide end face portion, so as to prevent the front end of the flange 9' from surpassing the inverted portion, thereby blocking the coil fastener elements from escaping from the gap between the top surface of the flange 9' and the blade 6'.

In recent years, a slide fastener attached to a fabric of clothes has been demanded to have plasticity and therefore, a knitted fastener tape having a warp knitting structure has been utilized. This knitted tape is so plastic that it is likely to be deformed. Thus, if it is intended to release the slide fastener by pulling the fabric forcibly, the fastener elements invade into the tape guide groove from the rear end of the flange as well. Therefore, if the tape guide groove is formed narrower to make it difficult for the fastener elements to invade into the tape guide groove, wales of the knitted tape and flange located within the tape guide groove are excessively pressed so that the sliding resistance of the slider is increased, thereby disabling an easy operation of the slider.

The invention has been accomplished considering the above-described problems. A main object of the invention is to provide a slide fastener in which a flange on a side of a rear mouth of a slider is capable of maintaining fastener elements in a stabilized condition even in any use condition without pressing a surface of a wale on a tape of a knitting structure and further, the fastener elements are prevented from biting into a tape guide groove between the flange and a blade opposing this flange and escaping from the tape guide groove, thereby ensuring a smooth sliding of the slider.

Another object of the invention is to provide a slide fastener capable of maintaining the slider in a stabilized condition with respect to a knitted tape and sliding the slider smoothly so as to prevent an occurrence of troubles.

Still another object of the invention is to provide a slide fastener in which the guide performance of the fastener elements is intensified and a rear end on the side of the rear mouth is disposed securely between wales of the knitted tape, thereby realizing a smooth operation of the slider under a stabilized condition.

Further, another object of the invention is to provide a slide fastener in which a bottom end face of the flange on the side of the rear mouth of the slider is disposed securely between the wales of the knitted tape with a simple configuration so as to allow the slider to be operated under a stabilized condition. In addition, it is another object of the invention is to provide a slide fastener capable of exerting the function securely and effectively by specifying the structure of the bottom end face of the flange of the slider.

A still further object of the invention is to provide a slide fastener which can be utilized effectively with a slider having a specific configuration by specifying the knitting structure of the tape used for the slide fastener.

A still further object of the invention is to provide a slide fastener which is capable of exerting an excellent function even if the fastener elements are deformed or moved more or less during use by specifying the kind of the fastener elements used for the slide fastener and which is a stabilized high-quality knitted slide fastener.

SUMMARY OF THE INVENTION

As for the main structures of the slide fastener of the invention, fastener elements are attached to opposing side edges of a pair of tapes and the slide fastener comprises a slider capable of engaging and separating, each fastener tape is composed of a knitting structure having a plurality of wales which are continuous in a longitudinal direction of the fastener tape, the slider has a element guide channel, through which the fastener elements pass, within a slider body and has flanges for guiding fastener elements, the flanges being disposed on both sides of the element guide channel and extending from a side of the shoulder mouth to a side of the rear mouth of the slider body, and each flange on the side of the rear mouth of the slider is disposed at the region between the fastener elements and a wale in a vicinity of the fastener elements, so that the slider can be slid on the basis of the region between the fastener elements and the wale.

Preferably, the region between the fastener elements attached to the knitted tape and the thick wale in the vicinity of the fastener element is formed of a thin knitted fabric thinner than the thickness of the wale so as to guide the flange on the side of the rear mouth of the slider.

Because such a structure allows the flange portion on the side of the rear mouth of the slider to slide between the wales of the knitted tape, contact with the wales is reduced thereby smoothing the sliding of the slider. Further, the fastener elements are prevented from biting into a tape guide groove between the flange and the lower blade when the fastener chain is operated for release and escaping from the tape guide groove.

In the invention, preferably, a side of a shoulder mouth of the flange is formed wide while the side of the rear mouth is formed narrower than the side of the shoulder moth. Consequently, the flange of the slider can be maintained in a stabilized condition and guided securely and smoothly.

Preferably, an outer side face on the side of the rear mouth of the flange in the slider is provided with a notch portion, the notch portion being cut out in a oblique shape or key shape continuously along the bottom end face of the flange, and the bottom end face of the flange is formed narrower than a proximal portion of the flange. Consequently, when the slider is operated for closing the fastener chain, the thick portion of the flange allows a smooth closing and when it is operated for opening, the slider can be guided smoothly by the narrow portion of the flange.

Further, preferably, the flange has a bent portion expanding a width of the element guide channel toward the side of the shoulder mouth of the slider and a parallel portion holding a constant width of the element guide channel toward the side of the rear mouth of the slider, and the notch portion is formed parallel to the parallel portion with increasing a notch amount in the bent portion. Consequently, the simple configuration of the outer side face of the flange allows the flange to be disposed securely between the fastener elements and the wale, thereby achieving an effective opening and closing operation of the slider.

It is preferable that the knitted tape used for the fastener tape is composed of a warp knitting structure, because according to the structure, wales can be swelled from the surface of the tape and the flange of the slider can be guided securely and smoothly. In addition, it is preferable that the fastener elements are composed of coil or zigzag continuous fastener elements made of polyamide fiber or polyester fiber mono-filament, because according to the feature, the continuous fastener elements may be moved more or less with respect to the fastener tape or deformed easily, thereby exerting an excellent function to this type of the slider.

Further preferably, the coil or zigzag continuous fastener elements are attached to a surface on a side edge of a warp knitted tape by knitting with knitting yarns such that they are placed on the side edge. Consequently, the continuous fastener elements are knitted into the warp knitted tape in an optimum configuration as the slide fastener and attached in a stabilized condition, thereby a high-quality, knitted slide fastener being finished.

Preferably, the flange has a bent portion expanding a width of the element guide channel toward the side of the shoulder mouth of the slider and a parallel portion holding a constant width of the element guide channel toward the side of the rear mouth of the slider, and the parallel portion is disposed at the region between the fastener elements and a wale in a vicinity of the fastener elements. The fastener elements attached to the pair of tapes are engaged at the element guide channel at the side of the rear mouth of the slider. Therefore, when the flanges at the side of the rear mouth are formed in parallel, each flange is guided linearly in the region between the fastener elements and the wale in a vicinity of the fastener elements, so that the operation of the slider is performed more smoothly.

DETAILED DESCRIPTION OF PREFERRED EMBODIMENTS

Hereinafter, a preferred embodiment of the invention will be described with reference to the accompanying drawings.

Figure 1:
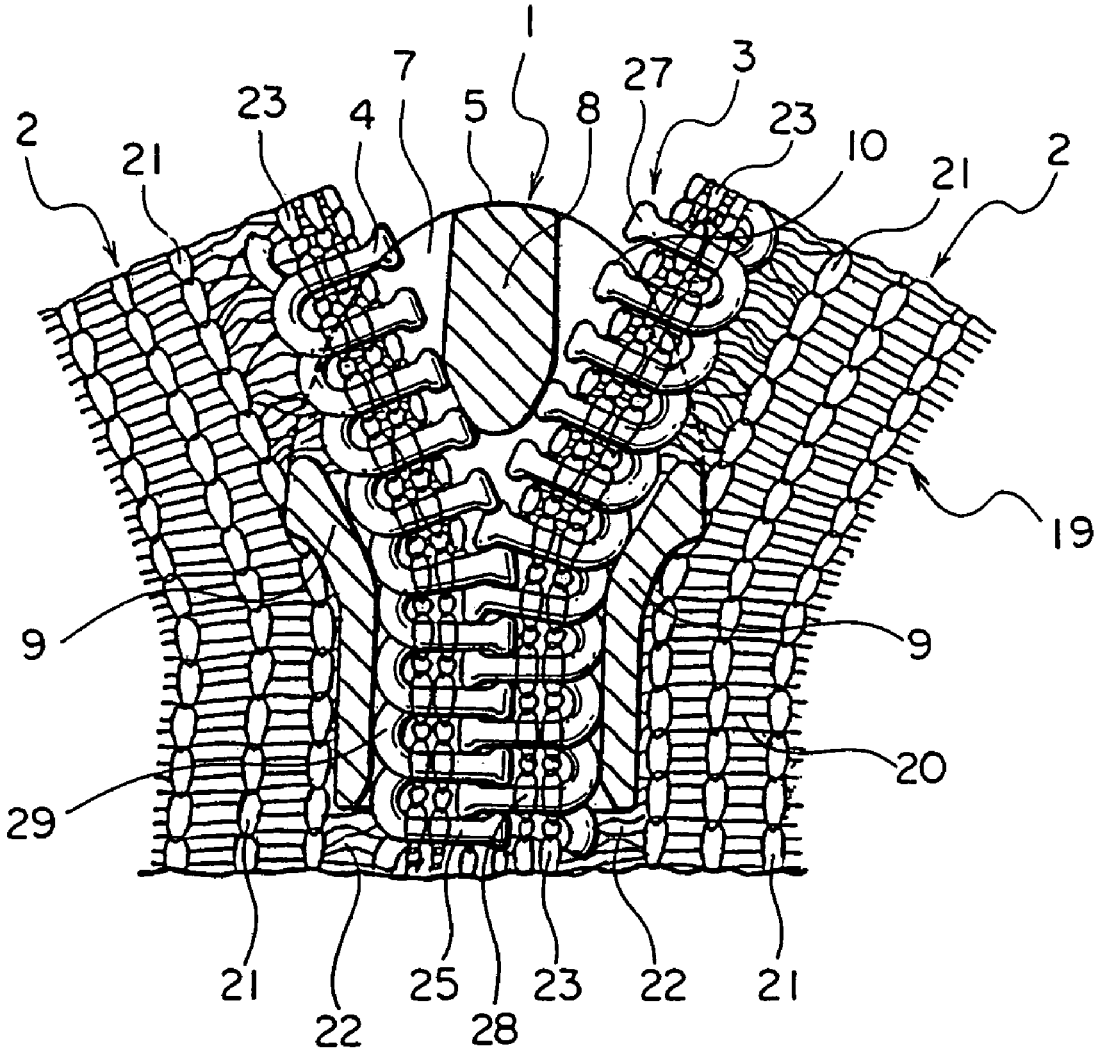
FIG. 1 is a front view of a fastener chain, in which a slider is mounted on a warp knitted tape and a top half portion of the slider is cut out.

In a slide fastener of the invention, as shown in FIG. 1, a pair of fastener tapes 2 used for the slide fastener is composed of a knitting structure and particularly, a knitted tape 19 preferable for the fastener tape 2 is a warp knitted tape 20 composed of a warp knitting structure rather than a weft knitting structure. The knitting structure of this warp knitted tape 20 is formed with multiple kinds of knitting yarns such as chain knitting yarn, tricot knitting yarn, two-needle-stitch yarn, weft in-laid yarn each composed of polyamide fiber or polyester fiber multi-filament and wales 21 are swelled from the surface of the tape.

Figure 2:
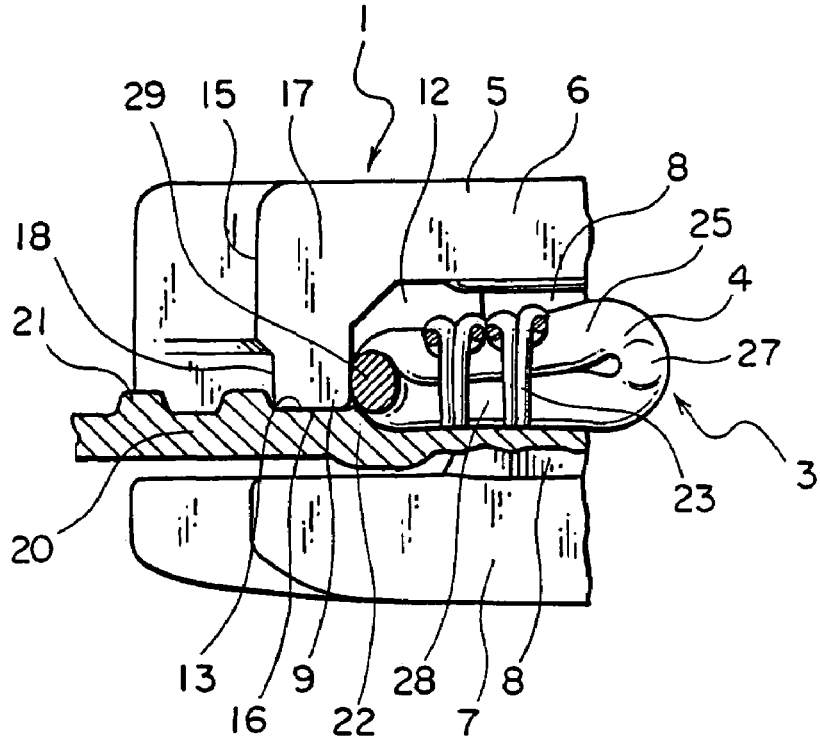
FIG. 2 is a partial view showing part of the slider, in which coil fastener elements are attached to the warp knitted tape by sewing.

Continuous fastener elements 4 are attached along a side edge of a face of the warp knitted tape 20, in which the wales 21 appear, by forming polyamide or polyester mono-filament in a coil shape as fastener elements 3. Then, as shown in FIG. 2, coil fastener elements 25 are knitted in with synthetic fiber knitting yarns 23. In the coil fastener elements 25, leg portions 28 of the coil fastener elements 25 are knitted on the side edge of the warp knitted tape 20 with the knitting yarns 23 so that heads 27 of the coil fastener elements 25 are projected from the side edge of the warp knitted tape 20. Then, inverted portions 29 of the coil fastener elements 25 are disposed on the warp knitted tape 20 and entirely the coil fastener elements 25 are placed on the warp knitted tape 20 and mounted thereon. A thin knitted fabric 22 thinner than the wale 21 exists outside the inverted portions 29 of the knitted-in coil fastener elements 25. That is, a thin knitted fabric 22 exists outside the inverted portions 29 of the knitted coil fastener element 25. That is, the thin knitted fabric 22 exists outside the inverted portions 29 of the coil fastener element 25 and the thick wale 21 exists adjacent this knitted fabric 22, so that a concave portion is formed between the inverted portions 29 and the wale 21. This knitted fabric 22 becomes a region to be faced by the flange 9 of the slider 1, which is described later.

Figure 3:
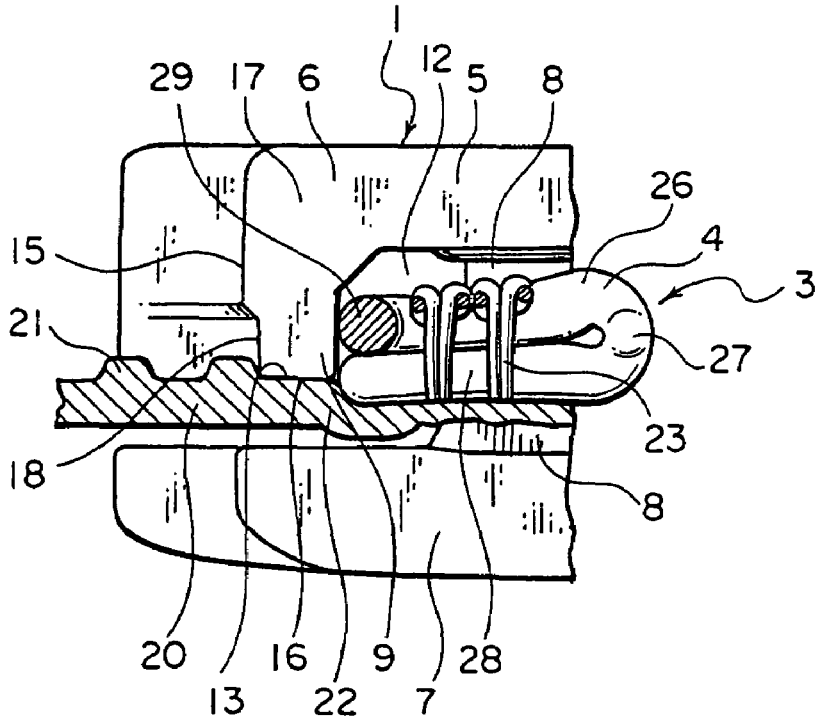
FIG. 3 is a partial view showing part of the slider, in which zigzag fastener elements are attached to the warp knitted tape by sewing.

Alternately, as shown in FIG. 3, zigzag fastener elements 26 are used for continuous fastener elements 3 and the leg portions 28 of the zigzag fastener elements 26 are knitted on the side edge of the warp knitted tape 20 with the knitting yarn 23 like the coil fastener elements 25, so that the heads 27 of the zigzag fastener elements 26 are projected from the side edge of the warp knitted tape 20.

It is possible that the continuous fastener elements such as the coil fastener elements or the zigzag fastener elements are placed on the surface of the side edge of the warp knitted tape and the leg portions of the continuous fastener element are sewed with sewing threads of multi-thread chain-stitch or the like, so that the thin knitted fabric is formed between the inverted portions and the wale outside the inverted portions of the continuous fastener elements. Consequently, the same function as the knitting-in case described previously can be exerted.

The slider 1 has a substantially Y-shaped element guide channel 12, through which the fastener elements 3 can pass, within the body 5. The slider 1 can allow the fastener elements 3 to be engaged or separated by sliding along the fastener elements 3.

A body 5 of the slider 1 is formed by die-casting aluminum alloy or zinc alloy or by pressing brass or stainless steel. Further, the body 5 of the slider 1 may be molded by injection-molding with thermoplastic resin such as polyamide, polyacetal, polypropylene, and polybutylene terphthalate.

Figure 4:
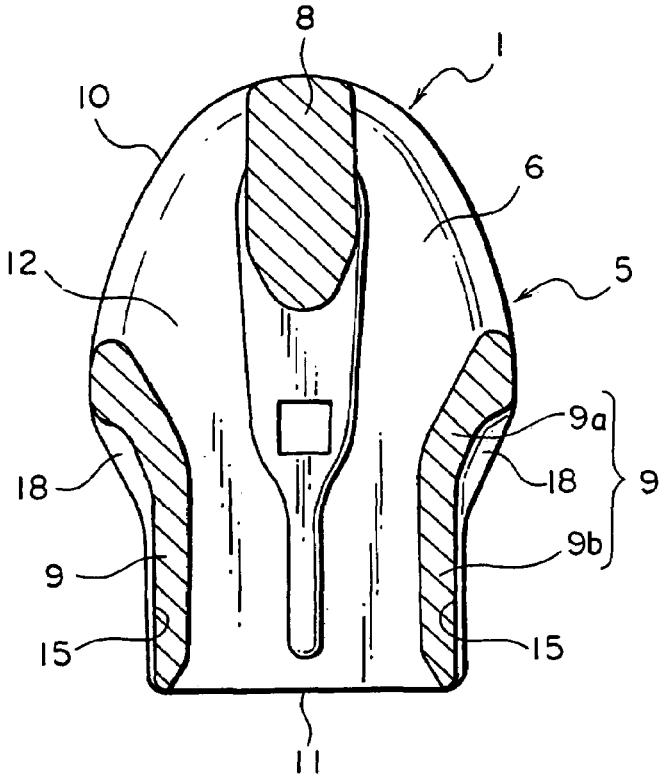
FIG. 4 is a sectional view showing a top half portion of the slider.
Figure 5:
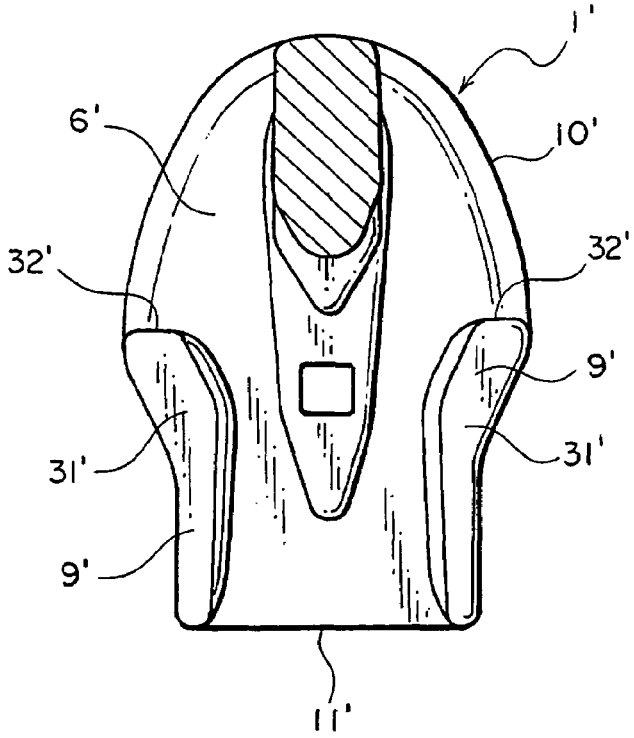
FIG. 5 PRIOR ART
FIG. 5 is a sectional view showing a top half portion of a well known slider.

The body 5 of the slider 1 connect an upper blade 6 and a lower blade 7 via a guide post 8, and the element guide channel 12 through which the continuous fastener elements 4 can pass is formed between the upper blade 6 and the lower blade 7. Further, the flange 9 for guiding the continuous fastener elements 4 passing through the element guide channel 12 is provided so as to be bent at each of both outer side edges of the upper blade 6. A tape guide groove 13 is provided between the bottom end face 16 of the flange 9 and the lower blade 7, and the fastener tape 2 can be inserted through the tape guide groove 13. The flange 9 is extended from the side of the shoulder mouth 10 of the slider 1 toward the side of the rear mouth 11 of the slider 1, and the flange 9 has a bent portion 9*a* expanding the width of the element guide channel 12 toward the side of the shoulder mouth 10 of the slider 1 and a parallel portion 9*b* holding the constant width of the element guide channel 12 from the bent portion 9*a* toward the side of the rear mouth 11 of the slider 1. A bottom end face 16 of the flange 9, the bottom end face opposing the lower blade 7, is flat and the lateral width of the bottom end face 16 of the flange 9 is different between a front end of the flange on the side of a shoulder mouth 10 and a rear end of the flange on the side of a rear mouth 11. As shown in FIG. 1, the flanges 9 is so constructed that the bottom end faces 16 of the parallel portions 9*b* of the right and left flanges 9 at the rear end of the rear mouth 11 oppose thin knitted fabric 22 existing between the fastener elements 3 and the wale 21, while the lateral width of each bottom end face 16 can be inserted into the concave portion. As shown in FIG. 4, the lateral width of the bottom end face 16 of the parallel portion 9*b* is expanded more or less. Thus, although part of the wide flange 9 at the front end overlaps the wale 21, the sliding resistance is not so much affected because the warp knitted tape 20 has plasticity. Depending on the case, an outside of the bottom end face 16 at the front end may be chamfered obliquely.

To form the bottom end face 16 of the flange 9 in a smaller width, as shown in FIGS. 2 and 3, an outer side face 15 of the flange 9 is cut out in an oblique shape or a key shape toward the bottom end face 16 so as to provide with a notch portion 18, so that the bottom end face 16 is formed with a smaller width than a proximal portion 17. Further, the bottom end face 16 of the flange 9 is so formed from the rear end on the side of the rear mouth 11 up to the front end on the side of the shoulder mouth 10 that the bottom end face 16 of the parallel portion 9*b* has the same lateral width while the bent portion 9*a* is expanded more or less, so that when the right and left continuous fastener elements 4 receive a tension in the lateral direction, the front end of the flange 9 is prevented from being caught by a gap between the inverted portions 29 of the continuous fastener elements 4. Further it is permissible to form only part of the front end on the side of the shoulder mouth 10 on the bottom end face 16 of the flange 9 into a larger width. The notch portion 18 to be formed in the outer side face 15 of the flange 9 is so formed that the notch amount of the bent portion 9*a* is larger than that of the parallel portion 9*b*, so as to make most portion of the flange 9 oppose the thin knitted fabric 22 between the fastener elements 3 and the wale 21, thereby reducing contact between the flange 9 and the wale 21 when the slider 1 is slid.

The slide fastener of the invention is formed with the above-described structure, that is, the flange 9 of the slider 1 is so formed that at least the parallel portion of the flange 9 starting from the rear end on the side of the rear mouth 11 avoids the wale 21 and slides on the thin knitted fabric 22 existing at the region between the fastener element 3 and the wale 21. Consequently, engagement operation of the right and left continuous fastener elements 4 is facilitated and further, when the fastener chain is operated for release, the continuous fastener elements 4 is prevented from biting into the tape guide groove 13 between the flange 9 and the lower blade 7 opposing the flange and escaping from the tape guide groove 13.

What is claimed is:

1. A slide fastener in which fastener elements are attached to opposing side edges of a pair of fastener tapes and the slide fastener comprises a slider capable of engaging and separating the fastener elements, wherein each fastener tape is composed of a knitting structure having a plurality of wales which are continuous in a longitudinal direction of the fastener tape, the slider has an element guide channel, through which the fastener elements pass, within a slider body and has flanges for guiding fastener elements, the flanges being disposed on both sides of the element guide channel and extending from a side of a shoulder mouth to a side of a rear mouth of the slider, and in a portion of each flange on the side of the rear mouth of the slider, a bottom end face of the portion is disposed at a region formed of a thin knitted fabric thinner than a wale, the region between an outside end face of an inverted portion of the fastener element and a wale facing the outside end face.

2. A slide fastener according to claim 1, wherein each of the flanges is so formed that the side of the shoulder mouth of the slider is wide while the side of the rear mouth of the slider is narrower than the side of the shoulder mouth.

3. A slide fastener according to claim 1, wherein an outer side face of each of the flanges on the side of the rear mouth has a notch portion cut out continuously along a bottom end face and the bottom end face having the notch portion of the flange is formed with a smaller width than a proximal portion of the flange.

4. A slide fastener according to claim 3, wherein each of the flanges has a bent portion expanding a width of the element guide channel toward the side of the shoulder mouth of the slider and a parallel portion holding a constant width of the element guide channel toward the side of the rear mouth of the slider, and the notch portion is formed parallel to the parallel portion with increasing a notch amount in the bent portion.

5. A slide fastener according to claim 1, wherein each fastener tape composed of the knitting structure is comprised of a warp knitted tape composed of a warp knitting structure.

6. A slide fastener according to claim 1 or 5, wherein the fastener elements are composed of continuous fastener elements formed of synthetic fiber mono-filament.

7. A slide fastener according to claim 6, wherein the continuous fastener elements are knitted into a surface on a side edge of a warp knitted tape with knitting yarns such that they are placed on the surface on the side edge.

8. A slide fastener according to claim 1, wherein each of the flanges has a bent portion expanding a width of the element guide channel toward the side of the shoulder mouth of the slider and a parallel portion holding a constant width of the element guide channel toward the side of the rear mouth of the slider, and the parallel portion is disposed at the region between the fastener element and a wale adjacent to the fastener element.

* * * * *